US008991922B2

(12) United States Patent
Bisman et al.

(10) Patent No.: US 8,991,922 B2
(45) Date of Patent: Mar. 31, 2015

(54) LUMBAR SUPPORT FOR A CHAIR

(75) Inventors: Christopher Warren Bisman, Porirua (NZ); Damon Gregory Burwell, Wellington (NZ); Leif Robert John Roy, Lower Hutt (NZ); Paul Michael Wilkinson, Wellington (NZ)

(73) Assignee: Formway Furniture Limited, Lower Hutt (NZ)

( * ) Notice: Subject to any disclaimer, the term of this patent is extended or adjusted under 35 U.S.C. 154(b) by 321 days.

(21) Appl. No.: 13/468,118

(22) Filed: May 10, 2012

(65) Prior Publication Data

US 2012/0306247 A1 Dec. 6, 2012

Related U.S. Application Data

(60) Provisional application No. 61/492,547, filed on Jun. 2, 2011.

(51) Int. Cl.
*A47C 7/46* (2006.01)

(52) U.S. Cl.
CPC ..... *A47C 7/462* (2013.01)
USPC ..... 297/284.4; 297/284.5

(58) Field of Classification Search
USPC ..... 297/284.7, 284.4, 284.5, 228.13
See application file for complete search history.

(56) References Cited

U.S. PATENT DOCUMENTS 4,844,539 A * 7/1989 Selbert ..... 297/228.13
5,112,106 A * 5/1992 Asbjornsen et al. ..... 297/284.7
5,551,752 A 9/1996 Lovegrove et al.
5,560,683 A * 10/1996 Penley et al. ..... 297/452.56
5,611,598 A 3/1997 Knoblock
5,615,928 A * 4/1997 Penley ..... 297/452.56
5,624,157 A * 4/1997 Kostuk ..... 297/228.13
5,772,282 A 6/1998 Stumpf et al.
5,791,733 A 8/1998 van Hekken et al.
5,902,011 A 5/1999 Hand et al.
6,079,785 A 6/2000 Peterson et al.
6,126,235 A * 10/2000 Grove ..... 297/284.7
6,394,546 B1 5/2002 Knoblock et al.
6,419,318 B1 * 7/2002 Albright ..... 297/284.7
6,499,801 B1 * 12/2002 Peterson et al. ..... 297/228.13
6,575,530 B1 6/2003 Fischer et al.

(Continued)

FOREIGN PATENT DOCUMENTS

JP 2001112575 4/2001
WO 2010068122 A1 6/2010

OTHER PUBLICATIONS

International Search Report of PCT/NZ2012/000065 dated Jun. 18, 2013.

(Continued)

*Primary Examiner* — David R Dunn
*Assistant Examiner* — Alexander Harrison
(74) *Attorney, Agent, or Firm* — Buchanan Ingersoll & Rooney PC

(57) ABSTRACT

A lumbar support for a chair includes a member having a first portion separated from a second portion via a slit formed in the member and a slider mechanism. The slider mechanism has a slider that is moveable from a first position to a second position. The first and second portions of the member are attached to each other when the slider is at the second position via the slider. The first and second portions of the member are unattached at the second position when the slider is moved from the second position to the first position.

25 Claims, 6 Drawing Sheets

(56) References Cited

U.S. PATENT DOCUMENTS

| | | | | |
|---|---|---|---|---|
| 6,626,494 | B2 * | 9/2003 | Yoo | 297/296 |
| 6,908,159 | B2 | 6/2005 | Prince et al. | |
| D511,914 | S | 11/2005 | Edwards et al. | |
| 7,641,283 | B2 * | 1/2010 | Rumack | 297/219.12 |
| 2003/0111886 | A1 | 6/2003 | Footitt | |
| 2005/0121958 | A1 * | 6/2005 | Edwards et al. | 297/284.7 |
| 2007/0052272 | A1 | 3/2007 | Fabel | |
| 2008/0150337 | A1 | 6/2008 | Bilak et al. | |
| 2009/0218864 | A1 | 9/2009 | Parker et al. | |
| 2010/0141000 | A1 | 6/2010 | Chadwick et al. | |

OTHER PUBLICATIONS

Written Opinion of the International Searching Authority for PCT/NZ2012/000065 dated Jun. 18, 2013.

* cited by examiner

LUMBAR SUPPORT FOR A CHAIR

CROSS REFERENCE TO RELATED APPLICATIONS

The present application claims priority to U.S. Provisional Application No. 61/492,547, which was filed on Jun. 2, 2011.

FIELD OF INVENTION

The present invention relates to furniture, such as chairs. More particularly, the present invention relates to an adjustable lumbar support for chairs.

BACKGROUND OF THE INVENTION

Chairs may include lumbar supports. Examples of lumbar supports in chairs may be appreciated from U.S. Pat. Nos. 6,908,159, 6,575,530, 6,394,546, 6,079,785, 5,902,011, 5,791,733, 5,772,282, 5,611,598, 5,551,752, U.S. Patent Application Publication Nos. 2010/0141000, 2009/0218864 and 2003/0111886 and International Patent Application Publication No. WO/2010/068122. Typically, lumbar supports are attached to the back frame of a chair and are configured to engage the back skin of the chair back when a user leans back against the back skin. Some types of lumbar supports are configured to press against the back skin to force the back skin into a bowed shape. Other types of lumbar supports are configured to passively support a user's back by providing additional support to the back skin after a user has pushed the back skin sufficiently far enough to engage the lumbar support.

Many lumbar supports do not permit a user to adjust the amount of support provided by the lumbar support. For instance, many lumbar supports are simply pads that are permitted to be repositioned in a number of different locations, but provide the same support to the back skin at each position. While the different position may change the mechanical advantage of support provided by the lumbar support for some of these types of lumbar support, the lumbar support itself does not provide any adjustable amount of support to a user's back independent of the position of the lumbar support.

A new lumbar support is needed that may permit additional support to be provided to a user's back when sitting on a chair that provides a lower cost of manufacturing and easy use for the seated user. Preferably, the lumbar support is designed to permit the lumbar support to provide an adjustable amount of support so that a user may adjust the lumbar support to provide a desired amount of support.

SUMMARY OF THE INVENTION

A chair is provided that includes a lumbar support. The lumbar support includes a member that is preferably composed of a polymeric sheet of material. The member has a first portion and a second portion and a slit formed therein between the first and second portions. The lumbar support also includes a slider mechanism. The slider mechanism has a slider that is moveable from a first position located adjacent the slit to a second position located adjacent the slit along the member. When the slider is in the second position, the first and second portions are attached to each other at the second position via the slider. When the slider is moved from the second position to the first position the first and second portions are unattached at the second position.

In one embodiment of the chair, the chair may include a back having a back frame attached to a back skin, a seat, and a base. The base may be attached to at least one of the back and the seat to support the back and the seat. The chair may also include a lumbar support. The lumbar support may be attached to the back. The lumbar support can include a member having a first portion separated from a second portion via a slit formed in the member and a slider mechanism. The slider mechanism may have a slider that is moveable from a first position located adjacent the slit to a second position located adjacent the slit. The first and second portions can be attached to each other at the second position via the slider when the slider is in the second position and the first and second portions can be unattached at the second position when the slider is moved from the second position to the first position.

Preferably, the member is attached directly to the skin of a chair back via a plurality of clips. Of course, the member may be attached to the back of a chair in a number of other ways as well. For instance, the member may be attached to a back frame of a chair back.

In some embodiments, the slit may define the path of travel for the slider. The first and second portions may also have teeth formed thereon adjacent to the slit to define the path of travel for the slider. In some embodiments, when the slider moves from the first position to the second position, the slider may close the slit. Conversely, when the slider moves from the second position to the first position, the slider may open the slit. The slider may move along the slit via the teeth to close or open the slit. For such embodiments, the slider mechanism may be considered a zipper mechanism or a zipper.

In other embodiments, the slider may only attach the first and second portions together at the position in which the slider is moved along the slit. For instance, the first and second portions may only be attached together at the second position when the slider is at the second position. The first and second portions may be unattached at all other positions along the slit other than the second position when the slider is in the second position. For such embodiments, the extent of movement of the first portion independent of the second portion may decrease as the slider moves from the first position to the second position.

In one embodiment, the lumbar support device for a chair may include a member having a first portion separated from a second portion via a slit formed in the member and a slider mechanism. The slider mechanism may have a slider that is moveable adjacent the slit from a first position to a second position. The first and second portions are attached to each other at the second position via the slider when the slider is in the second position and the first and second portions are unattached at the second position when the slider is moved from the second position to the first position.

Other details, objects, and advantages of the invention will become apparent as the following description of certain present preferred embodiments thereof and certain present preferred methods of practicing the same proceeds.

BRIEF DESCRIPTION OF THE DRAWINGS

Present preferred embodiments of our chair, lumbar support, and methods of making and practicing the same are shown in the accompanying drawings. It should be appreciated that like components or like parts may be indicated by the same reference number throughout the different drawings.

DETAILED DESCRIPTION OF PRESENT PREFERRED EMBODIMENTS

Figure 1:
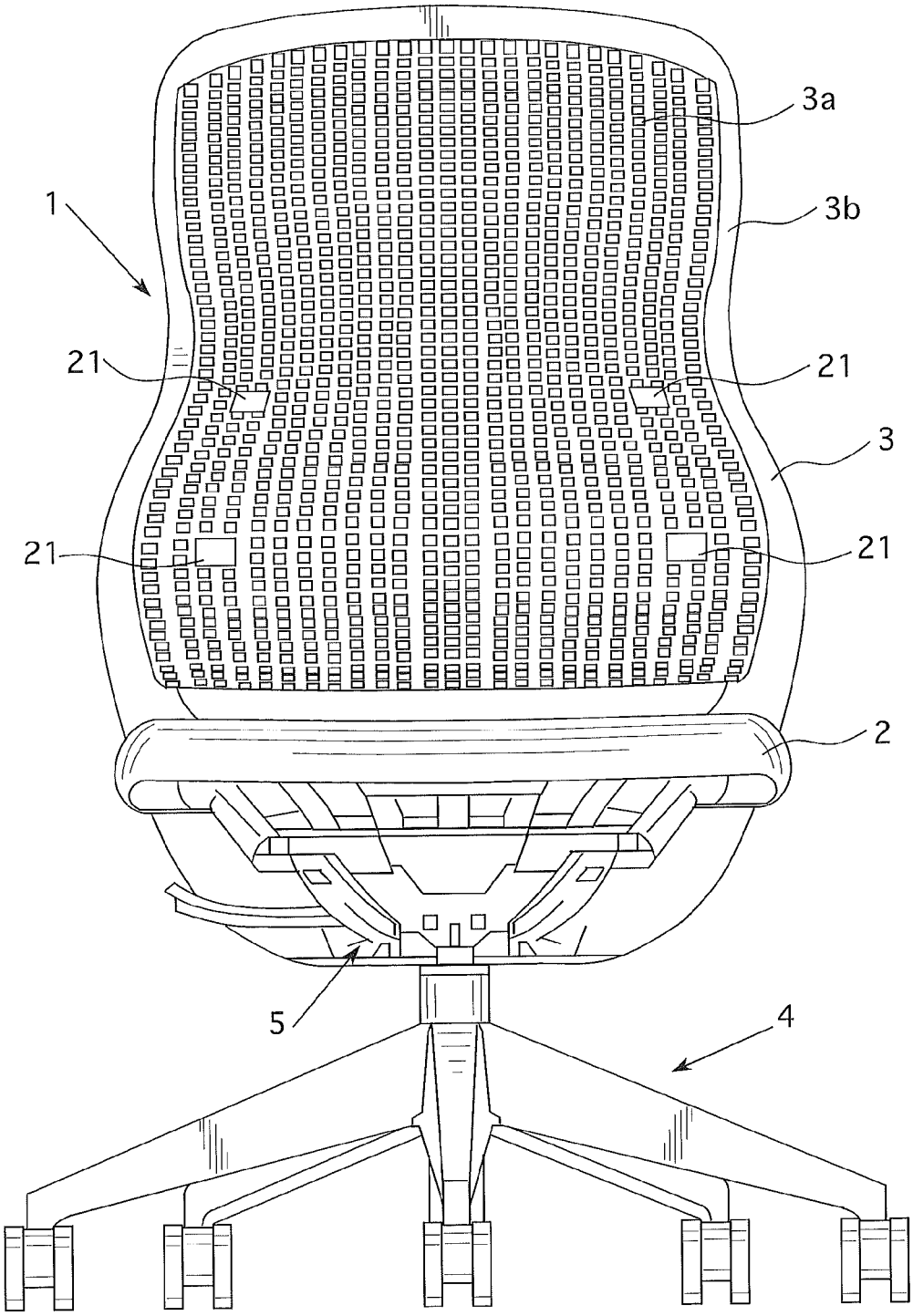
FIG. 1 is a front perspective view of a first present preferred embodiment of a chair.
Figure 2:
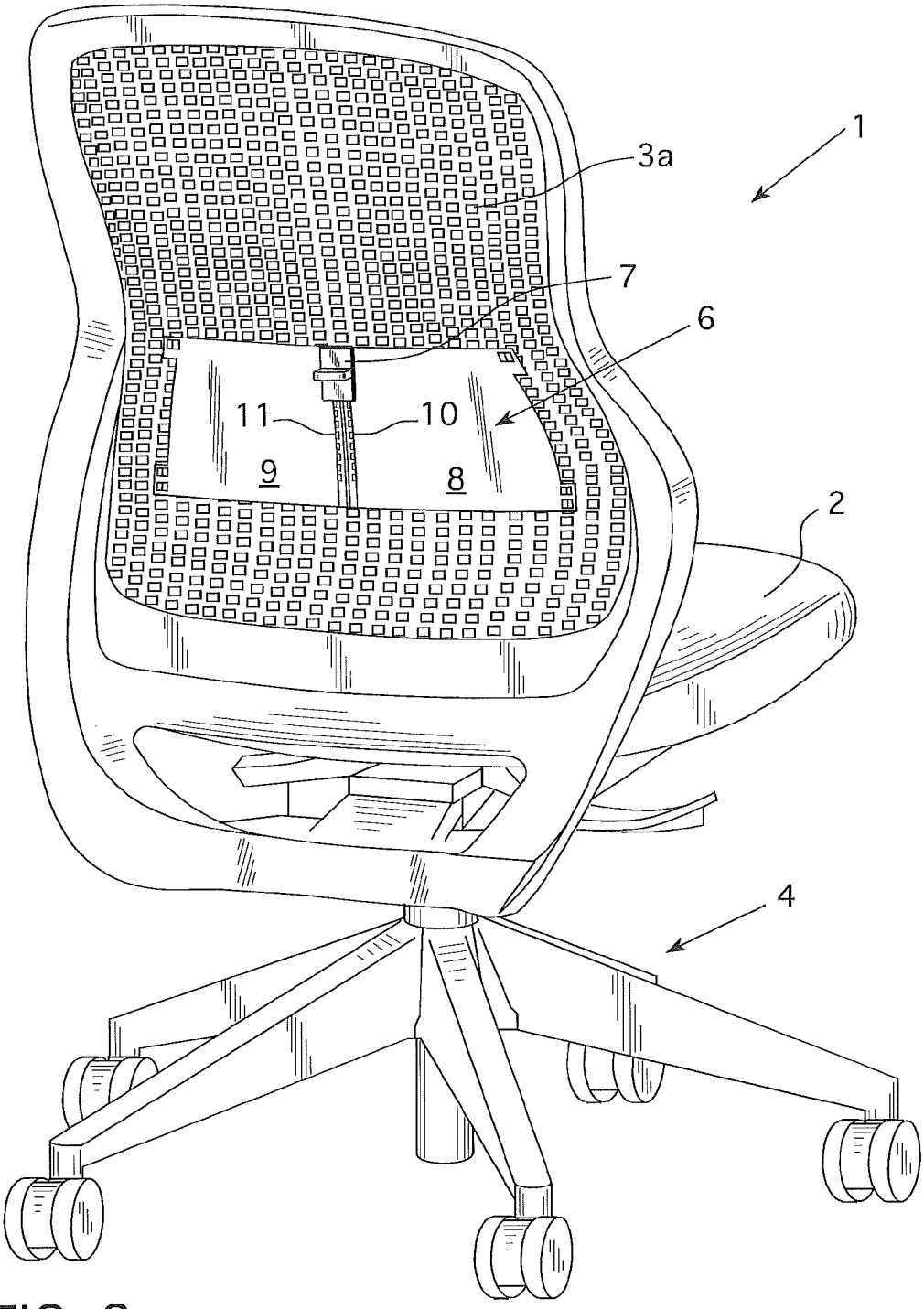
FIG. 2 is a rear perspective view of the first present preferred embodiment of the chair with the slider of the lumbar support shown in an upper position.

Referring to FIGS. 1-6, a chair 1 has a seat 2 and a back 3 that is supported by a chair base 4. A tilt mechanism 5 may be attached to the base to control movement of the seat, back, or both the seat and back when a user sits in the chair so that the back may recline when a user presses against the chair back. In some embodiments, the base 4 and tilt mechanism 5 may be configured to also permit the seat to move when the back is reclined to provide synchronous movement of the seat and back when the back is reclined.

The base may be a pedestal that has multiple castors and a gas spring that permits height adjustment of the base. Of course, alternative embodiments of the chair may utilize a base that includes a plurality of legs or may utilize a chair that does not have a tilt mechanism 5 or a back that is reclinable. Alternative embodiments of the chair may also include a seat 2 and back 3 that are portions of an integral shell or integral member that are supported by a chair base such as a pedestal or a plurality of legs. In some embodiments, the seat may be attached to the base so that the seat depth position is adjustable.

The chair 1 may be configured to include armrests that are attached to the base 4 or to the back 3 of the chair. Other embodiments of the chair may not include armrests. The armrests may be height adjustable or may be include moveable arm pads that are adjustable independent of the armrest height adjustment mechanism. Of course, other embodiments may be designed to merely permit armrest height adjustment or may not permit any armrest adjustment.

The back 3 of the chair may include a back skin 3*a* that extends from a back frame to cover one or more openings defined by the back frame. The back skin 3*a* may be a mesh material or a polymeric sheet of material that includes a plurality of openings or holes. Alternate embodiments of the back 3 may utilize a skin 3*a* that is a sheet of material or a sheet of fabric. In yet other embodiments, the back may be an upholstered back that utilizes a fabric or leather back skin to cover foam or cushions supported by the back frame.

A lumbar support 6 is attached to the back 3 of the chair. Preferably, the lumbar support 6 is positioned adjacent to the rear of the back skin 3*a* so that a lumbar region or other region of a user's back receives additional support via the lumbar support when sitting in the chair. The lumbar support 6 may utilize clips 21 that attach the lumbar support 6 to the skin 3*a* of the back 3. The clips 21 may be configured to permit a user to attach the lumbar support to the skin 3*a* at one location and, thereafter, disconnect the clips 21 from the skin 3*a* and reattach the lumbar support 6 via the clips 21 at a different location to reposition or adjust the position of the lumbar support 6. Thus, the clips 21 may be configured to provide a releasable attachment to the back skin 3*a*. In alternative embodiments, the lumbar support may utilize clips, fasteners, or other attachment mechanisms to attach the lumbar support 6 to the back frame 3*b* or other components of the back, base, or seat to position the lumbar support adjacent to the back for providing support to a seated user's back.

The lumbar support 6 may include a member 6*a*. The member 6*a* may be a sheet or plate of polymeric material that includes a first portion 8 adjacent to a second portion 9. Alternatively, the lumbar support 6 may utilize some other member, such as a sheet of resilient material, a plate of resilient material or another structure that is positionable adjacent the back skin to provide lumbar support. The member 6*a* of the lumbar support may be composed of Xylex® material made by Sabic Innovative Plastics Holding BV. Alternatively, the member 6*a* may be composed of a different type of polymeric material or resilient material such as a type of plastic material, an elastomeric material, a woven material, a reinforced fabric material, and a polymeric material composed of a blend of polycarbonate material and an amorphous polyester, or a metal. The member 6*a* may have any of a number of shapes, such as circular, elliptical, polygonal, rectangular, triangular, or trapezoidal shapes.

A slider mechanism includes a slider 7 that may be positioned between the first and second portions 8 and 9 to permit those portions to be interconnectably separated. The slider 7 may include a handle 7*a* that is sized for a user to easily grab. The handle 7*a* may be attached to a slider body. The slider 7 may be configured so that when the slider is in an uppermost position, the slider 7 causes the first and second portions to be interconnected such that the first portion and second portion cannot move independent of each other. If a user leans back on the back skin 3*a* when the slider 7 is in the uppermost position, the whole member may yield or resiliently bend to accommodate the user's back while also providing a supplement of additional support to the back skin 3*a*. It should be understood that the slider can be moved to any of a number of positions between the lowermost position and the uppermost position to adjust the amount of support provided by the member 6*a* of the lumbar support.

Figure 3:
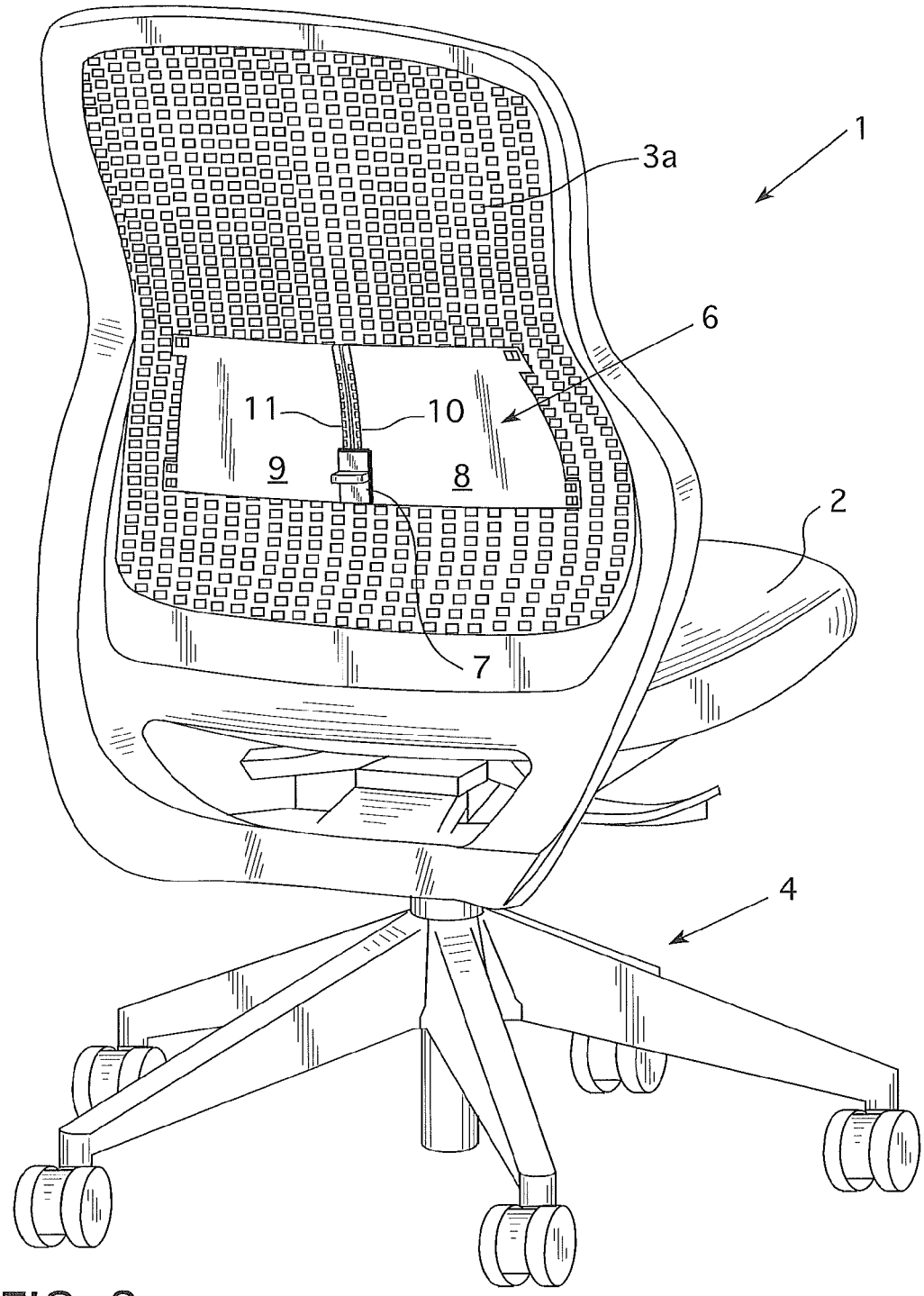
FIG. 3 is a rear perspective view of the first present preferred embodiment of the chair with the slider of the lumbar support shown in a lower position.

In contrast, if the slider 7 is moved to a lowermost position, as shown in FIG. 3, the first and second portions 8 and 9 may be separated by a slit formed in the member between the first portion 8 and second portion 9. As a result, the first portion 8 may move independent of the second portion 9. For example, if a user moves to place more pressure on the side of the back skin that is covered by the first portion 8, the first portion 8 may move more rearward and flex without the second portion 9 moving at all or flexing as a result of the movement of the first portion 8.

The movement of the slider 7 permits a user to adjust the support provided by the member 6*a* of the lumbar support 6. The slider mechanism permits the support provided by the lumbar support to be adjusted independently of any height adjustment that may be made to the lumbar support 6. When the slider 7 is in the lowermost position, the amount of support provided by the lumbar support 6 may be low. When the slider is in the uppermost position, the amount of support provided by the lumbar support may be increased since independent movement of the first and second portions is prevented from occurring.

The first portion 8 may have teeth 10 or a plurality of projections, notches, or steps formed thereon to at least partially define a path of travel for the slider 7 along the slit formed between the first and second portions. The second portion 9 may also have teeth 11, projections, notches, or steps formed thereon to also help define the path of travel for the slider 7.

The slider may be configured to move along the teeth 10, 11 via mating teeth formed on the slider that are configured to engage with teeth 10 and 11 to cause the teeth 10, 11 to interlock with each other to interconnect the first and second portions via their attachment to the slider as the slider is moved from a lowermost position to the uppermost position. The slider may also be configured so that the slider disconnects the teeth 10, 11 when moved from the uppermost position to the lowermost position to separate the first and second portions. For such embodiments, the slider mechanism 7 may be considered to function as a zipper.

It should be appreciated that the extent of the movement of the first portion 8 that is independent of the second portion 9 may be decreased as the slider moves upward along the path defined by the slit and teeth 10, 11 until the first portion and second portion are fully interconnected when the slider 7 is in the uppermost position. Conversely, when the slider 7 is moved from the uppermost position to the lowermost position, the extent of movement of the first portion 8 independent of the second portion 9 may increase.

In alternative embodiments, the slider 7 may be configured to move along the path defined by the slit and teeth 10, 11 such that the slider may only interconnect the first portion 8 and the second portion 9 at the position of the slider as it moves away from a first position or towards a second position or new position. For instance, the slider 7 may move from a lowermost position to an uppermost position via the slider body 7*b* that interconnects with the teeth 10, 11. The first and second portions 8, 9 may only be attached to each other at the position in which the slider is moved. The attachment of the first and second portions at the position of the slider is caused via the slider because the slider body's teeth interconnect with teeth 10, 11 on the first and second portions adjacent the slit to form the attachment between the first and second portions 8, 9. For instance, when the slider 7 is in the uppermost position, the remainder of the first and second portions may merely abut each along the slit or may be spaced apart from each other along the rest of the slit. The first and second portions at the uppermost position may be spaced apart from each other when the slider is in the uppermost position, but the teeth of the slider body may interconnect the first and second portions at the uppermost position via the slider body's teeth engaging with the teeth 10, 11 of the first and second portions 8, 9. The movement of the slider from the lowermost position to the uppermost position may adjust the extent of the independence of movement between the first and second portions 8, 9 as the slider moves from the lowermost position to the uppermost position. For example, when the slider 7 is at the uppermost position, the first and second portions may not move independent of each other. As the slider is moved from the upper most position to the lowermost position, the amount of independent movement between the first and second portions may increase.

Figure 4:
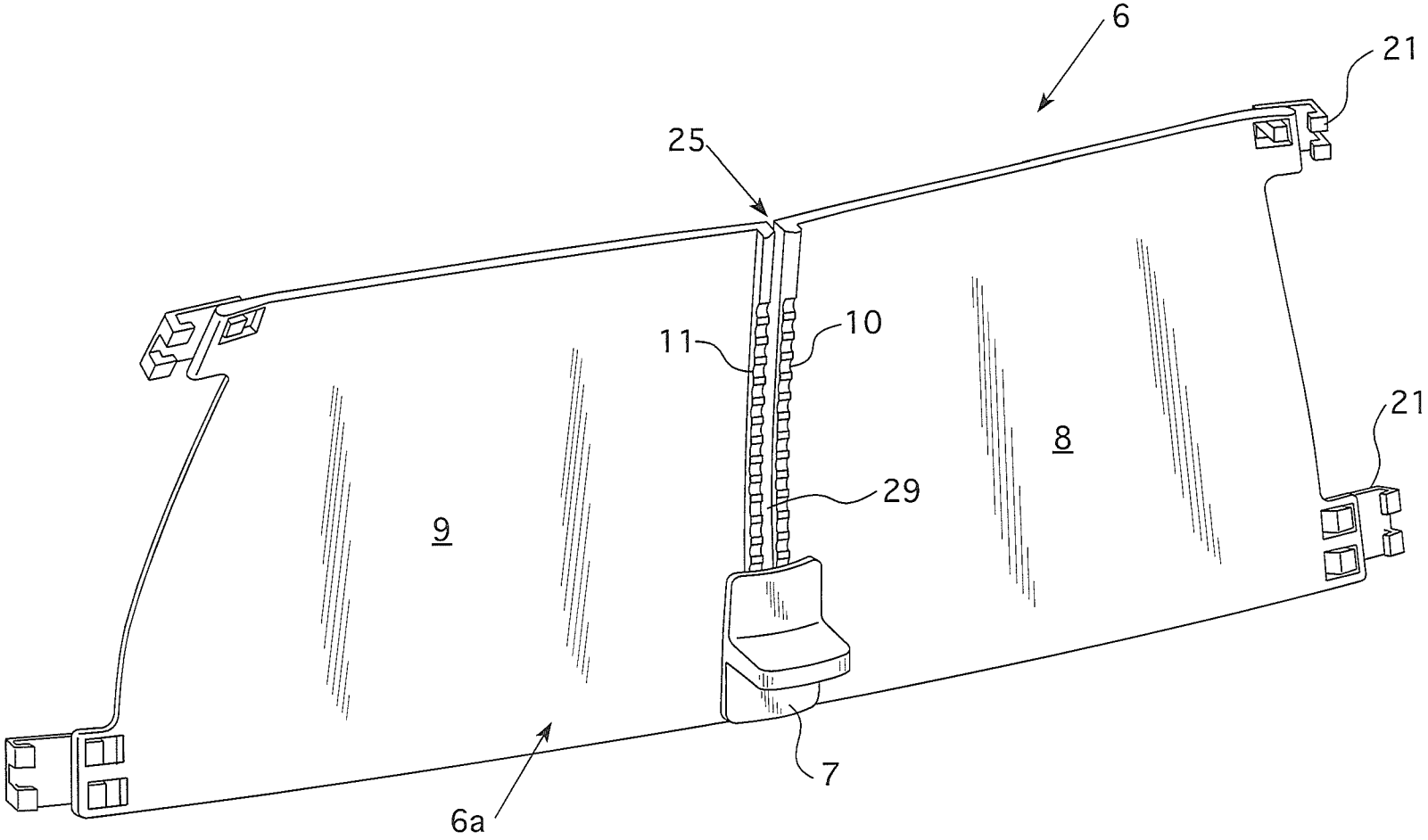
FIG. 4 is a perspective view of a first present preferred lumbar support with the slider of a slider mechanism shown in a lowered position.
Figure 5:
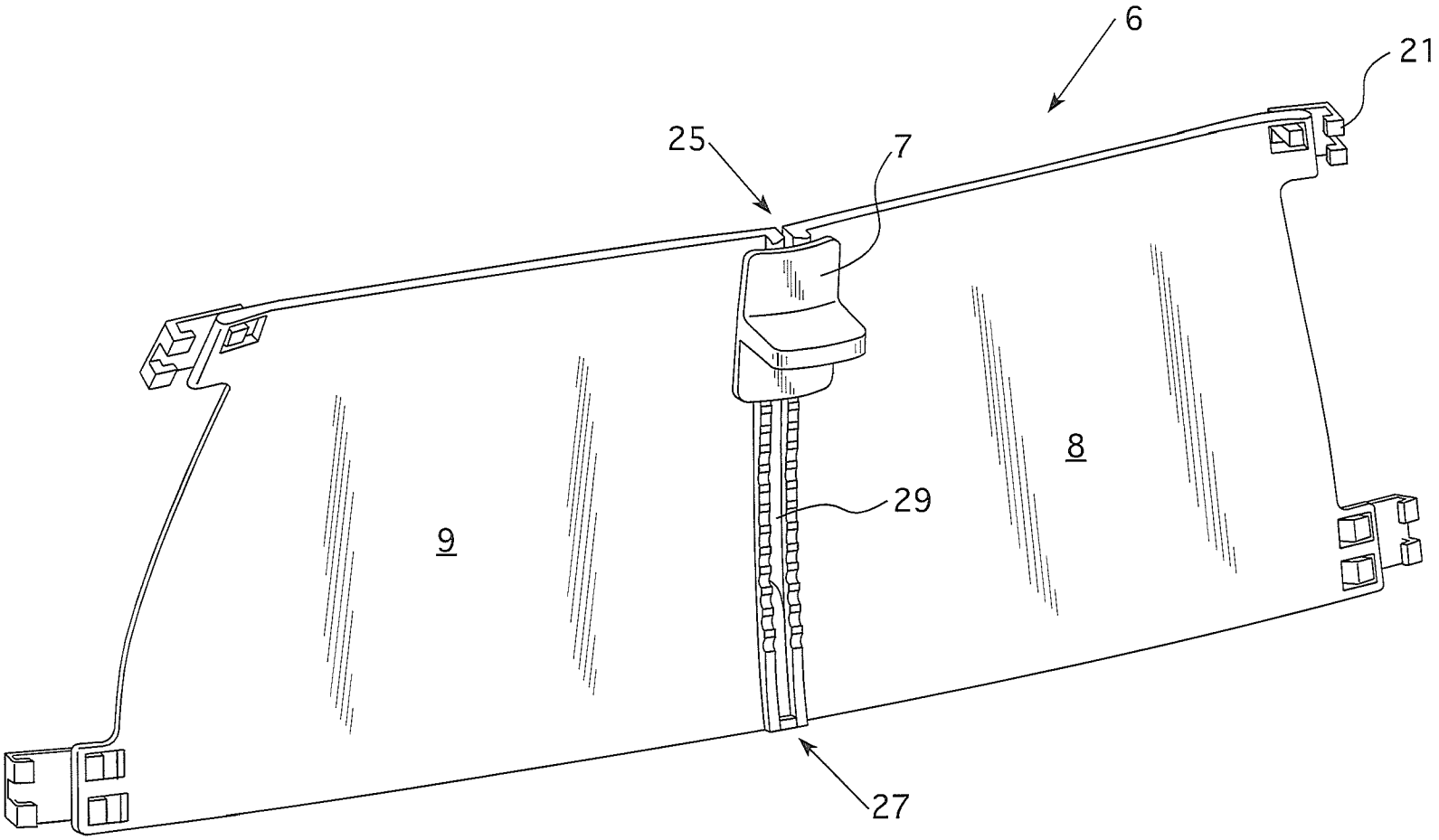
FIG. 5 is a perspective view of the first present preferred lumbar support with the slider shown in a raised position.
Figure 6:
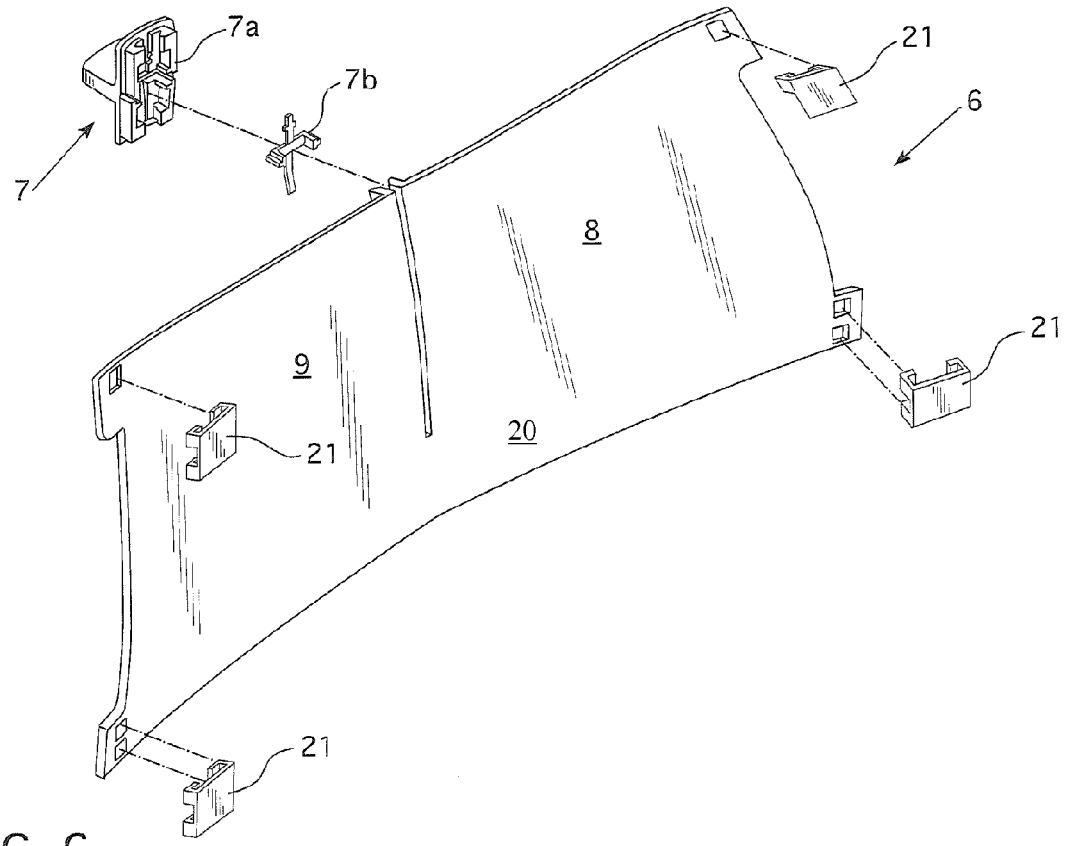
FIG. 6 is an exploded view of the first present preferred lumbar support.

As may be appreciate from FIGS. 4-6, the slit 29 may extend from the top of the member 6*a* to a mid portion or lower portion of the member to define a separation between the first 8 portion and second portion 9. The uppermost position 25 of the slider and the lowermost position 27 of the slider may be defined by teeth or may be defined by beads or protuberances formed on the first and second portions to locate the slider at those positions.

The lowermost position 27 of the slider may be a position that is below the first and second portions 8, 9. For instance, the lowermost position 27 of the slider may be a position formed on a third portion 20 of the member that is below the slit 29 and the first and second portions 8, 9. The third portion 20 can be integrally attached to the first and second portions 8, 9. The slider 7 may be moveable from the lowermost position defined on the third portion 20 of the member below the first and second portions 8, 9, to the uppermost position 25.

Alternatively, the lowermost position may be a lowermost portion of the slit at which the slider may be positioned. The movement of the slider from the lowermost position to the uppermost position may adjust the extent of the independence of movement between the first and second portions 8, 9 as the slider moves from the lowermost position to the uppermost position. For instance, a greater amount of independent movement between the first and second portions 8, 9 may occur if the first and second portions are only interconnected at the bottom of the slit than compared to when the first and second portions 8, 9 are interconnected at the uppermost position. As the slider is moved towards the uppermost position, the amount of force placed against the first portion 8 or second portion 9 that is needed to create independent movement may also increase.

It should be appreciated that variations may be made to the design of the lumbar support to meet a particular design objective. For example, the shape, of the member of the lumbar support may be any of a number of shapes. As yet another example, the dimensions of the lumbar support may be any of a number of dimensions such as length, width or thickness may be used for the member to define a shape or orientation of the member. As another example, the slider may be configured to move along a horizontally extending slit instead of a vertically extending slit.

As yet another example, the lumbar support may utilize more than one slit and more than one slider to adjust the strength or support provided by the member of the lumbar support. Each slit may have a length that extends vertically, horizontally, or on a different angle, such as a 45 degree angle relative to the ground or bottom of a back skin or bottom of the member of the lumbar support.

As yet another example, the lumbar support may effectively be inverted, so that the second position of the slider is positioned below the first position of the slider. The lumbar support member may have a third portion positioned above the slit 29 and the first and second portions 8, 9. In that arrangement, a greater amount of independent movement between the first and second portions 8, 9 may occur if the first and second portions are only interconnected at the top of the slit than compared to when the first and second portions 8, 9 are interconnected at the lowermost position. As the slider is moved towards the lowermost position, the amount of force placed against the first portion 8 or second portion 9 that is needed to create independent movement may also increase.

While certain present preferred embodiments of the chair, lumbar support, and methods of making and using the same have been shown and described above, it is to be distinctly understood that the invention is not limited thereto but may be otherwise variously embodied and practiced within the scope of the following claims.

What is claimed is:

1. A chair comprising:

a back, the back having a back frame attached to a back skin, the back skin;

a seat;

the back skin being configured to contact a user adjacent a front side of the back when the user is seated in the seat of the chair;

a base, the base attached to at least one of the back and the seat to support the back and the seat;

a lumbar support attached to a rear side of the back, the lumbar support comprising:

a member having a first portion separated from a second portion via a slit formed in the member, a slider mechanism, the slider mechanism having a slider that is moveable from a first position located adjacent the slit to a second position located adjacent the slit, the first and second portions being attached to each other at the second position via the slider when the slider is in the second position and the first and second portions being unattached at the second position when the slider is moved from the second position to the first position, the member being configured such that movement of the slider between the first and second positions adjusts support to the back skin of the chair provided by the lumbar support, a first amount of support being provided to the back skin of the chair by the lumbar support when the slider is in the first position and a second amount of support being provided by the back skin of the chair by the lumbar support when the slider is in the second position, the second amount of support being a greater amount of support than the first amount of support.

2. The chair of claim 1 wherein the back skin is comprised of a mesh material or a sheet of polymeric material having a plurality of holes formed therein.

3. The chair of claim 1 wherein the member is comprised of a plate comprised of polymeric material having the slit formed therein to define the path of travel for movement of the slider from the first position to the second position.

4. The chair of claim 3 wherein the member of the lumbar support has a top and a bottom and wherein the slit extends vertically from adjacent the top of the member to a position adjacent to the bottom of the member.

5. The chair of claim 1 wherein the first position is lower than the second position.

6. The chair of claim 1 wherein the member is attached to the skin of the back.

7. The chair of claim 6 wherein the lumbar support further comprises clips attached to the member, the clips attaching the member to the back skin.

8. The chair of claim 7 wherein the member of the lumbar support has a top and a bottom and wherein the member is comprised of a plate of polymeric material having the slit formed therein to define a path of travel for movement of the slider from the first position to the second position and wherein the slit extends vertically from a position adjacent to the top of the member to a position adjacent to the bottom of the member.

9. The chair of claim 8 wherein the first portion is moveable independent of the second portion unless the slider is in the second position.

10. The chair of claim 1 wherein the slider mechanism is a zipper mechanism.

11. The chair of claim 10 wherein the first portion has teeth formed therein adjacent the slit and the second portion has teeth formed therein adjacent the slit and the zipper mechanism has a slider body that is moveable along the teeth to interconnect the first portion and second portion as the slider body moves from the first position to the second position.

12. The chair of claim 11 wherein the slider body disconnects the first and second portions along the slit as the slider body moves from the second position to the first position.

13. The chair of claim 1 wherein an amount of force needed to independently move the first portion relative to the second portion increases as the slider is moved from the first position to the second position.

14. The chair of claim 1 wherein the member has a third portion integrally attached to the first and second portions, the third portion being below the first and second portions.

15. The chair of claim 14 wherein the first position of the slider is defined on the third portion of the member that is below the slit.

16. The chair of claim 1 wherein the first and second portions are only attached together at the second position when the slider is at the second position, the first and second portions being unattached at all other positions along the slit other than the second position when the slider is in the second position.

17. The chair of claim 1 wherein the member of the lumbar support is a plate that is comprised of polymeric material; and wherein the member is attached to clips, the clips being configured to releasably attach the member to the back skin such that a position of the lumbar support is adjustable via disconnection of the clips from the back skin and a reconnection of the clips to the back skin after the lumbar support is repositioned.

18. A lumbar support device for a chair comprising:

a member having a first portion separated from a second portion via a slit formed in the member, the member being attached to a plurality of attachment mechanisms, each of the attachment mechanisms sized and configured to attach the member to a rear side of a back skin of the chair, a front side of the back skin of the chair being opposite the rear side, the front side of the back skin of the chair being configured to contact a user when a user is to sit in the chair; and a slider mechanism, the slider mechanism having a slider that is moveable adjacent the slit from a first position to a second position, the first and second portions being attached to each other at the second position via the slider when the slider is in the second position and the first and second portions being unattached at the second position when the slider is moved from the second position to the first position; and the member being configured such that movement of the slider between the first and second positions adjusts support to the back skin of the chair to be provided by the lumbar support, a first amount of support to be provided to the back skin of the chair by the lumbar support when the slider is in the first position and a second amount of support to be provided to the back skin of the chair by the lumbar support when the slider is in the second position, the second amount of support being a greater amount of support than the first amount of support.

19. The lumbar support device of claim 18 wherein the member also has a third portion positioned below the first portion and second portion, the third portion being integrally attached to the first and second portions.

20. The lumbar support of claim 19 wherein the first position is defined on the third portion below the slit.

21. The lumbar support of claim 18 wherein the slider mechanism is a zipper.

22. The lumbar support of claim 18 wherein the attachment mechanisms are comprised of clips attached to the member, the clips sized and configured to releasably attach the member to the back skin such that a position of the lumbar support is adjustable via disconnection of the clips from the back skin and a reconnection of the clips to the back skin after the lumbar support is repositioned.

23. The lumbar support of claim 18 wherein the first portion is moveable independent of the second portion unless the slider is in the second position.

24. The lumbar support of claim 18 wherein the first and second portions are only attached together at the second position when the slider is at the second position, the first and second portions being unattached at all other positions along the slit other than the second position when the slider is in the second position; and wherein an extent of movement of the first portion independent of the second portion decreases as the slider moves from the first position to the second position.

25. The lumbar support of claim 18 wherein the attachment mechanisms are clips that are configured to releasably attach the member to the back skin such that a position of the lumbar support is adjustable via disconnection of the clips from the back skin and a reconnection of the clips to the back skin after the lumbar support is repositioned; and wherein the member is a plate comprised of polymeric material.

* * * * *